US008418767B1

(12) United States Patent
Milanovich

(10) Patent No.: US 8,418,767 B1
(45) Date of Patent: Apr. 16, 2013

(54) BLOWOUT PREVENTER WITH A BERNOULLI EFFECT SUCK-DOWN VALVE

(75) Inventor: Philip John Milanovich, Phoenix, AZ (US)

(73) Assignee: Milanovich Investments, L.L.C., Phoenix, AZ (US)

( * ) Notice: Subject to any disclaimer, the term of this patent is extended or adjusted under 35 U.S.C. 154(b) by 0 days.

(21) Appl. No.: 13/533,964

(22) Filed: Jun. 26, 2012

Related U.S. Application Data

(63) Continuation-in-part of application No. 12/960,495, filed on Dec. 4, 2010, now Pat. No. 8,205,678.

(51) Int. Cl.
*E21B 43/01* (2006.01)

(52) U.S. Cl.
USPC ..... 166/354; 166/339; 166/343; 166/344; 166/367; 166/85.4; 405/158

(58) Field of Classification Search ..... 166/364, 166/338, 339, 341, 343–345, 351, 367–372, 166/381, 85.1, 85.4, 85.5; 405/52, 158
See application file for complete search history.

(56) References Cited

U.S. PATENT DOCUMENTS

| | | | |
|---|---|---|---|
| 1,543,456 | A | 6/1925 | Stirling |
| 3,980,138 | A | 9/1976 | Knopik |
| 4,220,207 | A | 9/1980 | Allen |
| 4,301,827 | A | 11/1981 | Murthy et al. |
| 4,376,467 | A | 3/1983 | Allen |
| 4,440,523 | A | 4/1984 | Milgram et al. |
| 4,568,220 | A | 2/1986 | Hickey |
| 4,605,069 | A | 8/1986 | McClaflin et al. |
| 4,969,676 | A | 11/1990 | LaMagna |
| 5,012,854 | A | 5/1991 | Bond |
| 5,199,496 | A | 4/1993 | Redus et al. |
| 6,026,904 | A | 2/2000 | Burd et al. |
| 6,059,040 | A | 5/2000 | Levitan et al. |
| 6,119,779 | A | 9/2000 | Gipson et al. |
| 6,601,888 | B2 | 8/2003 | McIlwraith et al. |
| 7,987,903 | B1 | 8/2011 | Prado Garcia |
| 8,016,030 | B1 | 9/2011 | Prado Garcia |
| 2010/0171331 | A1 | 7/2010 | Jonas et al. |

*Primary Examiner* — Daniel P Stephenson
(74) *Attorney, Agent, or Firm* — Swift & Swift; Stephen Christopher Swift

(57) ABSTRACT

The present invention is a blowout preventer including a large frustoconical funnel. The large end of the funnel is placed over a well pipe (or other pipe) through which oil (or gas or other fluid) is blowing out. The small end of the funnel is connected to a return pipe. A high pressure pipe with a smaller diameter is inserted into the well pipe. Air is pumped under high pressure through the high pressure pipe, separating the oil and forcing the oil, that is not kept down in the well pipe by the pressure, up through the return pipe. The funnel can be moved into alignment with the well pipe using jets. There are sensing devices on moveable arms. A stopper is forced into the well pipe. There are one-way valves in the stopper. There are stacked turbines in the return pipe. There is a gasket with pivoting overlapping plates.

19 Claims, 13 Drawing Sheets

BLOWOUT PREVENTER WITH A BERNOULLI EFFECT SUCK-DOWN VALVE

CROSS REFERENCE TO RELATED APPLICATION

This application is based on and claims the benefit of Regular Utility patent application Ser. No. 12/960,495, filed Dec. 4, 2010, which is incorporated herein by reference, and of which it is a Continuation-In-Part.

BACKGROUND OF THE INVENTION

1. Field of the Invention

The present invention relates to apparatus and methods for preventing the escape of fluid from wells or pipes.

2. Description of the Prior Art

As shown by recent events in the Gulf of Mexico, oil well blowouts are a serious threat to the environment, and can be very costly. Current blowout preventers can be unreliable. While there are numerous prior inventions of blowout preventers, none are equivalent to the present invention.

U.S. Pat. No. 1,543,456 issued on Jun. 23, 1925, to Robert Stirling, discloses a blowout preventer, without the Bernoulli effect of the instant invention.

U.S. Pat. No. 3,980,138, issued on Sep. 14, 1976, to Duane L. Knopik, discloses an underground fluid recovery device, but does not disclose a funnel that is placed over a pipe from which fluid is escaping, as in the instant invention.

U.S. Pat. No. 4,220,207, issued on Sep. 2, 1980, to Neil W. Allen, discloses seafloor diverter, without the use of the Bernoulli effect, as in the instant invention.

U.S. Pat. No. 4,301,827, issued on Nov. 24, 1981, to Rajam R. Murthy and Billy J. Rice, discloses a guided-float accumulator suitable for use with a hydraulic system for an oil well blowout preventer, using reaction forces that oppose Bernoulli effect forces, rather than making use of Bernoulli effect forces as in the instant invention.

U.S. Pat. No. 4,376,467, issued on Mar. 15, 1983, to Neil W. Allen, discloses without the use of the Bernoulli effect, as in the instant invention.

U.S. Pat. No. 4,440,523, issued on Apr. 3, 1984, to Jerome H. Milgram and James Burgess, discloses a separating collector for subsea blowouts, but without air or other fluid being pumped down to create a Bernoulli effect, as in the instant invention.

U.S. Pat. No. 4,568,220, issued on Feb. 4, 1986, to John J. Hickey, discloses a system for capping and/or controlling undersea oil or gas well blowouts, but without the use of the Bernoulli effect, as in the instant invention.

U.S. Pat. No. 4,605,069, issued on Aug. 12, 1986, to McClafin et al., discloses a method for producing heavy, viscous crude oil, but it is not a blowout preventer, as is the instant invention.

U.S. Pat. No. 4,969,676, issued on Nov. 13, 1990, to Joseph L. LaMagna, discloses an air pressure pick-up tool using the Bernoulli effect, but it is not a blowout preventer, as is the instant invention.

U.S. Pat. No. 5,012,854, issued on May 7, 1991, to John A. Bond, discloses a pressure release valve for a subsea blowout preventer that is hydraulically operated, without making use of the Bernoulli effect as in the instant invention.

U.S. Pat. No. 5,199,496, issued on Apr. 6, 1993, to Clifford L. Redus and Peter L. Sigwardt, discloses a subsea pumping device incorporating a wellhead aspirator, using the Bernoulli effect, but does not disclose a funnel placed over a pipe from which fluid is escaping, as in the instant invention.

U.S. Pat. No. 6,026,904, issued on Feb. 22, 2000, to James A. Burd and Kenneth J. Huber, discloses a method and apparatus for commingling and producing fluids from multiple production reservoirs, but it is not a blowout preventer, as is the instant invention.

U.S. Pat. No. 6,059,040, issued on May 9, 2000, to Leonid L. Levitan, Vasily V. Salygin and Vladimir D. Yurchenko, discloses a method and apparatus for the withdrawal of liquid from wellbores, but unlike the instant invention, it is not a blowout preventer.

U.S. Pat. No. 6,119,779, issued on Sep. 19, 2000, to Larry Joe Gipson and Stephen Leon Carn, discloses a method and system for separating and disposing of solids from produced fluids, but unlike the instant invention, it is not a blowout preventer.

U.S. Pat. No. 6,601,888, issued on Aug. 5, 2003, to Lon McIlwraith and Andrew Christie, discloses contactless handling of objects, using the Bernoulli effect, but unlike the instant invention, it is not a blowout preventer.

U.S. Pat. No. 7,987,903, issued on Aug. 2, 2011, to Jose Jorge Prado Garcia, discloses an apparatus and method for containing oil from a deep water oil well, but does not disclose the use of the Bernoulli effect, as in the instant invention.

U.S. Pat. No. 8,016,030, issued on Sep. 13, 2011, to Jose Jorge Prado Garcia, discloses an apparatus and method for containing oil from a deep water oil well, but does not disclose the use of the Bernoulli effect, as in the instant invention.

U.S. Patent Application Publication No. 2010/0171331, published on Jul. 8, 2010, discloses a Bernoulli gripper for holding two-dimensional components such as silicon-based wafers, but it is not a blowout preventer, as is the instant invention.

None of the above inventions and patents, taken either singly or in combination, is seen to describe the instant invention as claimed.

SUMMARY OF THE INVENTION

The present invention is a blowout preventer including a large frustoconical funnel or valve, made of metal or other suitable material. The large end of the funnel is placed over a well pipe (or other pipe) through which oil (or natural gas or other fluid) is blowing out. The small end of the funnel is connected to a return pipe. A high pressure pipe with a smaller diameter is inserted into the well pipe. Air is pumped under high pressure through the high pressure pipe, separating the oil and forcing the oil that is not kept down in the well pipe by the pressure up through the return pipe. The Bernoulli effect keeps the funnel on the well pipe. A first gasket at the top end of the channel prevents leaks. Channels and rotating blades near the top of the funnel accelerate the flow, reducing pressure and increasing the suction due to the Bernoulli effect. This results in the sucking down of the funnel into the oil flowing from the pipe, as the increased velocity of the oil acts like the thrust of a ram jet, forcing the funnel down onto the well pipe. In underwater applications, the added pressure provided by the water to the outside of the funnel will also aid in the attachment of the funnel to the well pipe. At a depth of one mile below the surface of the sea, the water pressure is 2,300 to 2,500 pounds per square inch.

This Continuation-In-Part includes the following additional features: 1. Jets by which the funnel may be moved into alignment with the well pipe. 2. Sensing devices on moveable arms. 3. A stopper that may be forced into the well pipe. 4.

One-way valves in the stopper. 5. Stacked turbines in the return pipe. 6. A second gasket with pivoting overlapping plates.

Accordingly, it is a principal object of the invention to prevent damage to the environment from oil well blowouts.

It is another object of the invention to prevent economic loss from oil well blowouts.

It is a further object of the invention to prevent damage to the environment from any kind of fluid escaping from a pipe.

Still another object of the invention is to prevent economic loss from any kind of fluid escaping from a pipe.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a blowout preventer that may be used with oil or gas wells, under the sea or on land.

Figure 1:
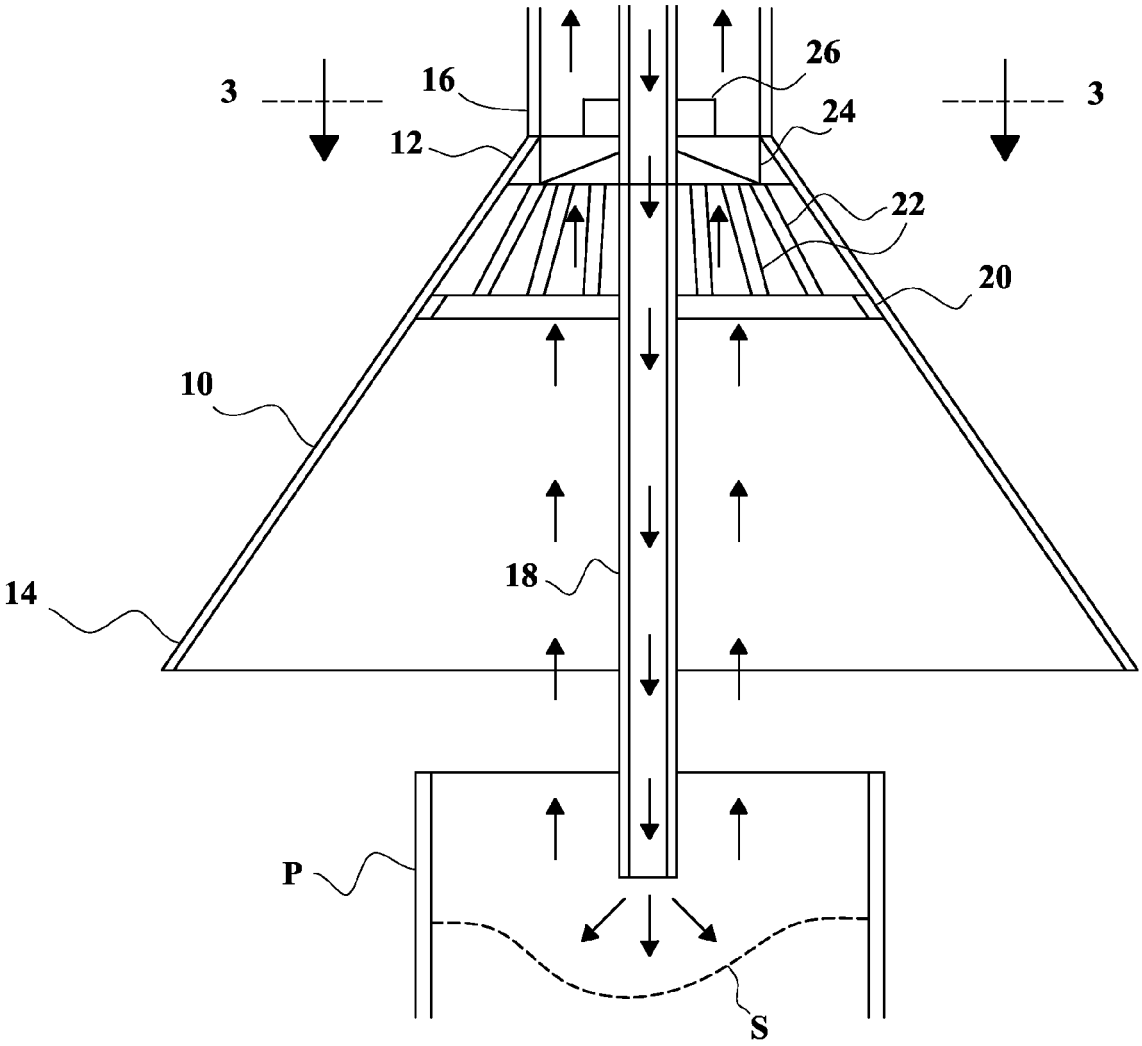
FIG. 1 is a vertical sectional view drawn along lines 1-1 of FIG. 3, showing the first preferred embodiment of the invention before the funnel is sucked down onto the pipe from which the first fluid is escaping.
Figure 3:
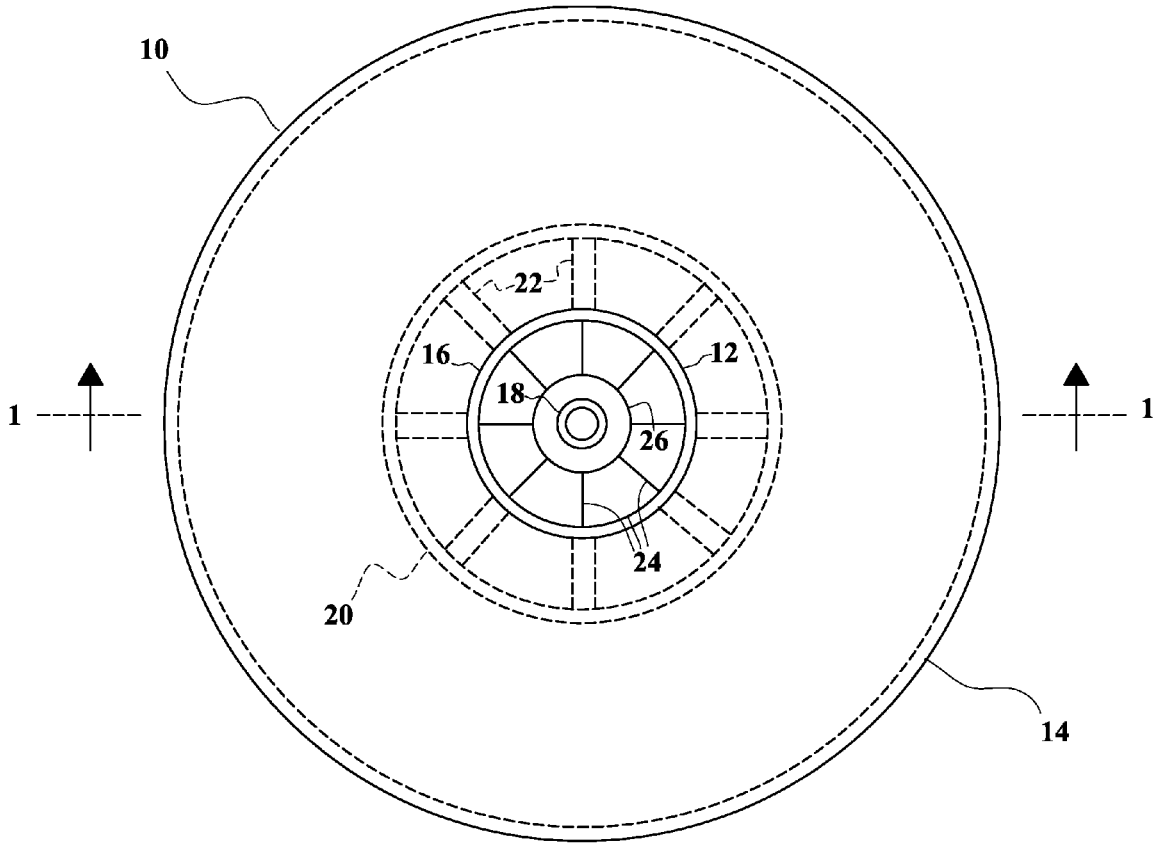
FIG. 3 is a horizontal sectional view drawn along lines 3-3 of FIG. 1, showing the first preferred embodiment of the invention.

FIG. 1 is a vertical sectional view drawn along lines 1-1 of FIG. 3, showing the first preferred embodiment of the invention before the funnel 10 is sucked down onto the pipe P (which may be a well pipe or riser) from which a first fluid (such as petroleum) is escaping. The funnel has a hollow frustoconical shape, and has a smaller end 12 and a larger end 14 that is suitably dimensioned and configured to be placed over the pipe. A return pipe 16 is connected to the smaller end of the funnel. A high pressure pipe 18 passes through the return pipe and the funnel, and is suitably dimensioned and configured to be inserted into the pipe P. A second fluid (such as air) is pumped through the high pressure pipe at a pressure greater than that of the first fluid, causing the first fluid to be separated by the second fluid in a space S adjacent to an end of the high pressure pipe that has been inserted into the pipe through which the first fluid is escaping. A portion of the first fluid that is not held back by the greater pressure of the second fluid will flow through the funnel and the return pipe at an accelerated velocity, but at a reduced pressure due to the Bernoulli effect, thus sucking the funnel down onto the pipe P.

Figure 2:
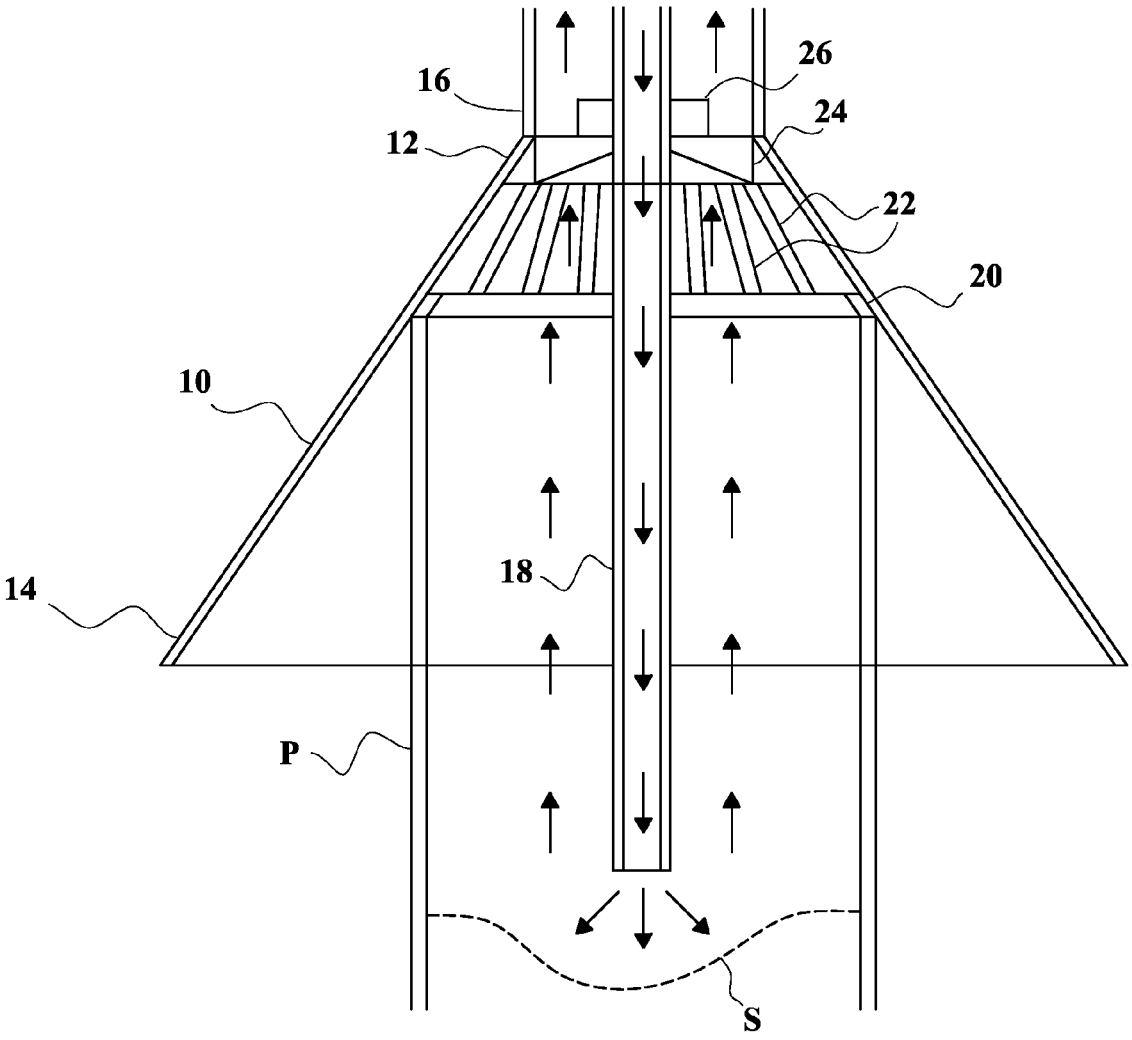
FIG. 2 is a vertical sectional view drawn along lines 1-1 of FIG. 3, showing the first preferred embodiment of the invention after the funnel is sucked down onto the pipe from which the first fluid was escaping.

FIG. 2 is a vertical sectional view drawn along lines 1-1 of FIG. 3, showing the first preferred embodiment of the invention after the funnel is sucked down onto the pipe P from which the first fluid was escaping. A first gasket 20 within the funnel prevents the first and second fluids from leaking out between the funnel and the pipe P. Inside the funnel, adjacent to its smaller end, there are channels 22 to further accelerate the flow of the first and second fluids toward the return pipe. (The channels may be small pipes.) Adjacent to the smaller end of the funnel there are blades 24 driven by motor 26, that can rotate to further accelerate the flow of the first and second fluids through the return pipe. FIG. 3 is a horizontal sectional view drawn along lines 3-3 of FIG. 1, showing the first preferred embodiment of the invention.

Figure 4:
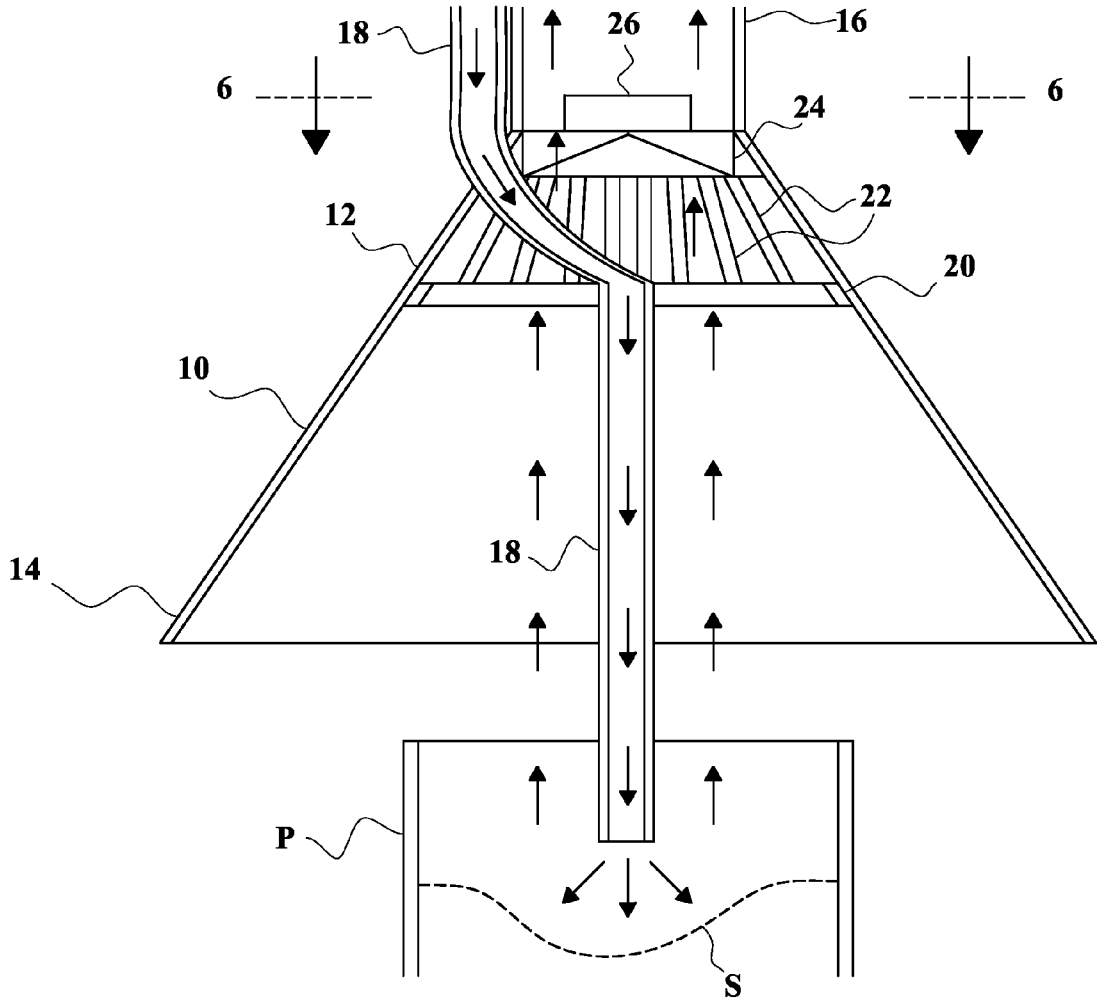
FIG. 4 is a vertical sectional view drawn along lines 4-4 of FIG. 6, showing the second preferred embodiment of the invention before the funnel is sucked down onto the pipe from which the first fluid is escaping.
Figure 5:
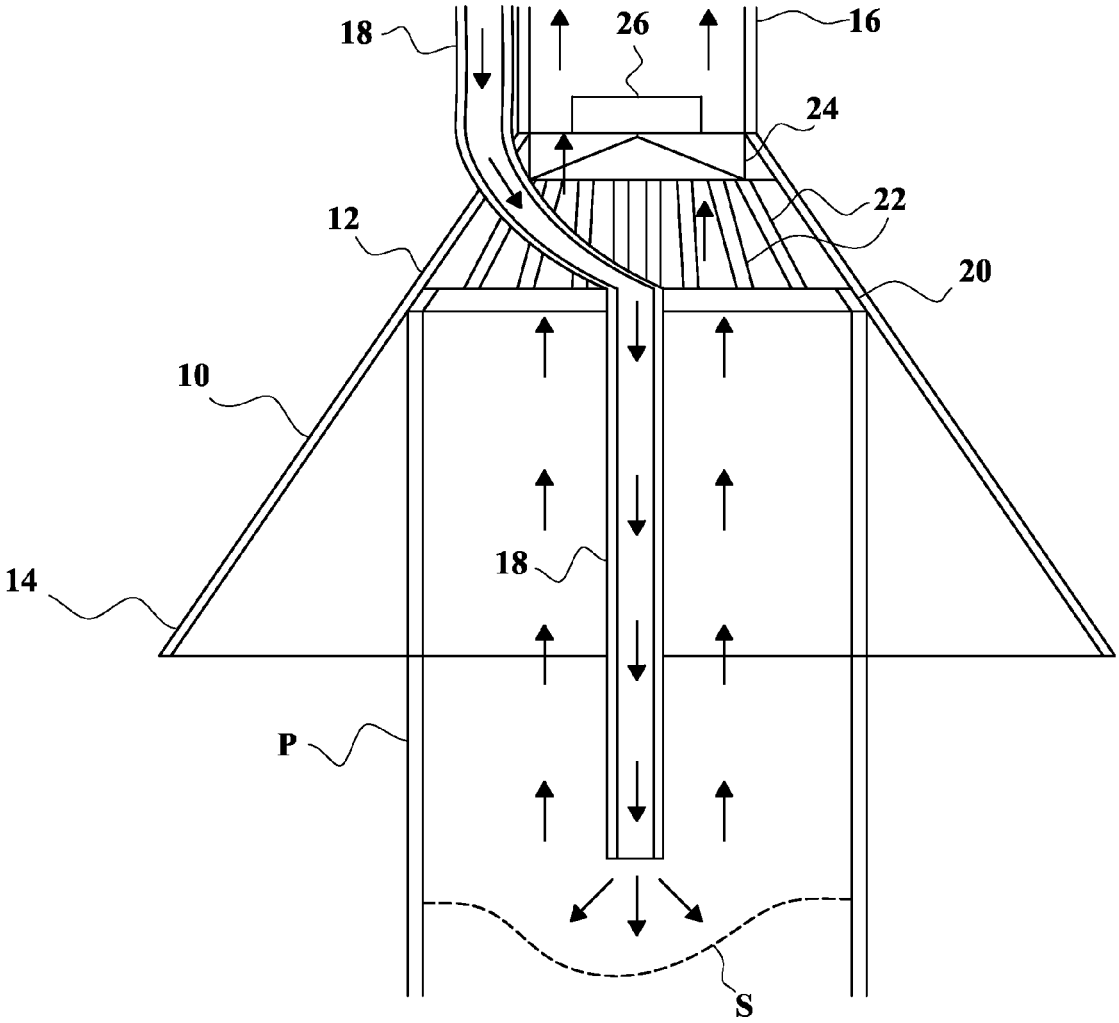
FIG. 5 is a vertical sectional view drawn along lines 4-4 of FIG. 6, showing the second preferred embodiment of the invention after the funnel is sucked down onto the pipe from which the first fluid was escaping.
Figure 6:
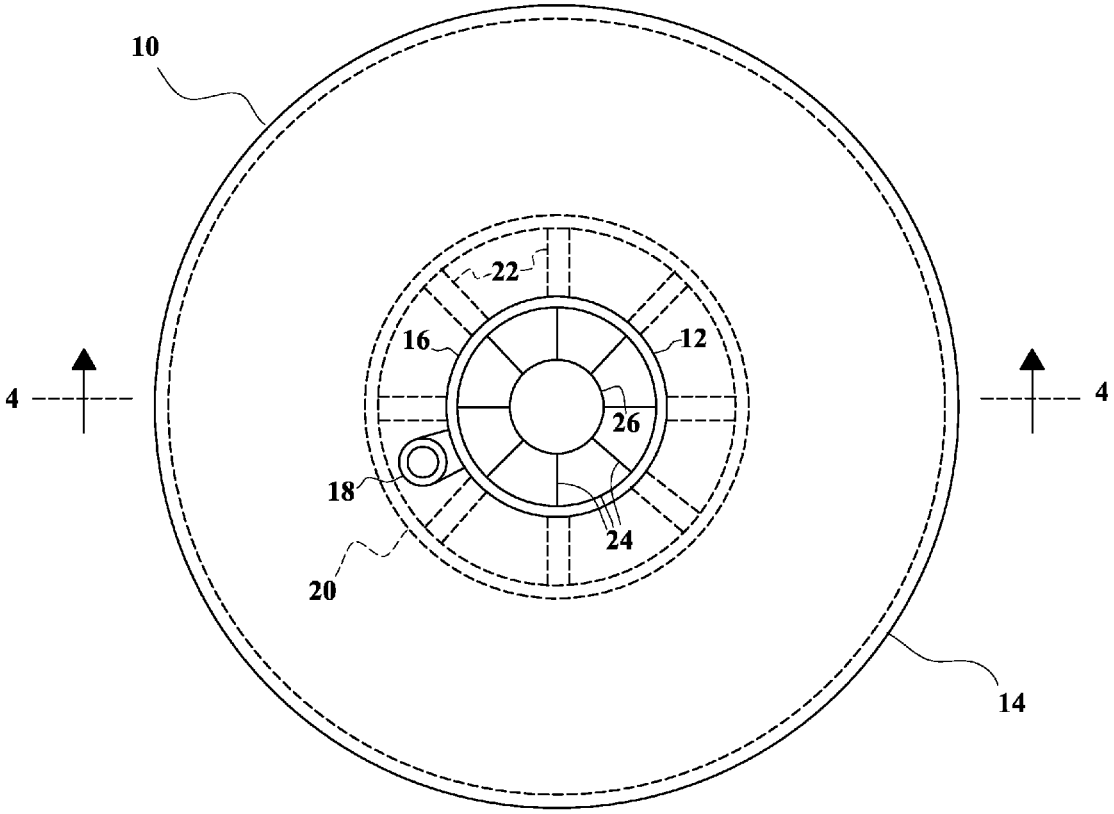
FIG. 6 is a horizontal sectional view drawn along lines 6-6 of FIG. 4, showing the second preferred embodiment of the invention.

FIG. 4 is a vertical sectional view drawn along lines 4-4 of FIG. 6, showing the second preferred embodiment of the invention before the funnel is sucked down onto the pipe from which the first fluid is escaping, which is the same as the first preferred embodiment, except that the high pressure pipe 18 is in an alternative position, passing outside the return pipe 16 and through a side of the funnel 10. FIG. 5 is a vertical sectional view drawn along lines 4-4 of FIG. 6, showing the second preferred embodiment of the invention after the funnel is sucked down onto the pipe from which the first fluid was escaping. FIG. 6 is a horizontal sectional view drawn along lines 6-6 of FIG. 4, showing the second preferred embodiment of the invention.

Figure 7:
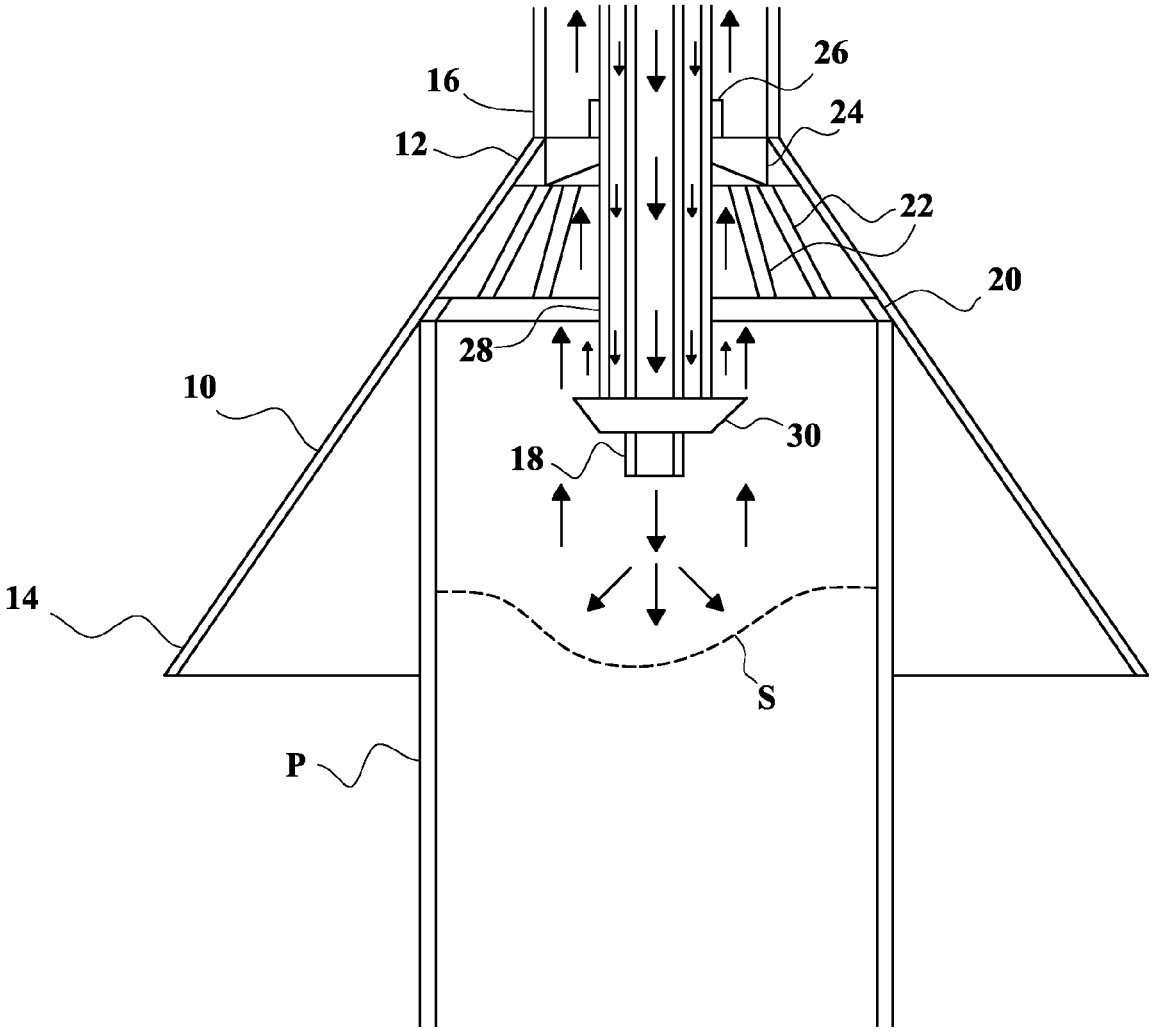
FIG. 7 is a vertical sectional view of the third preferred embodiment of the invention.

FIG. 7 is a vertical sectional view of the third preferred embodiment of the invention, in which there is a secondary air supply 28 with funnel 30, that can be used to keep the blades 24 turning if well pressure should decrease. The high pressure pipe 18 is shown retracted back up into the funnel, which is also a means of keeping the blades turning if well pressure decreases.

Figure 8:
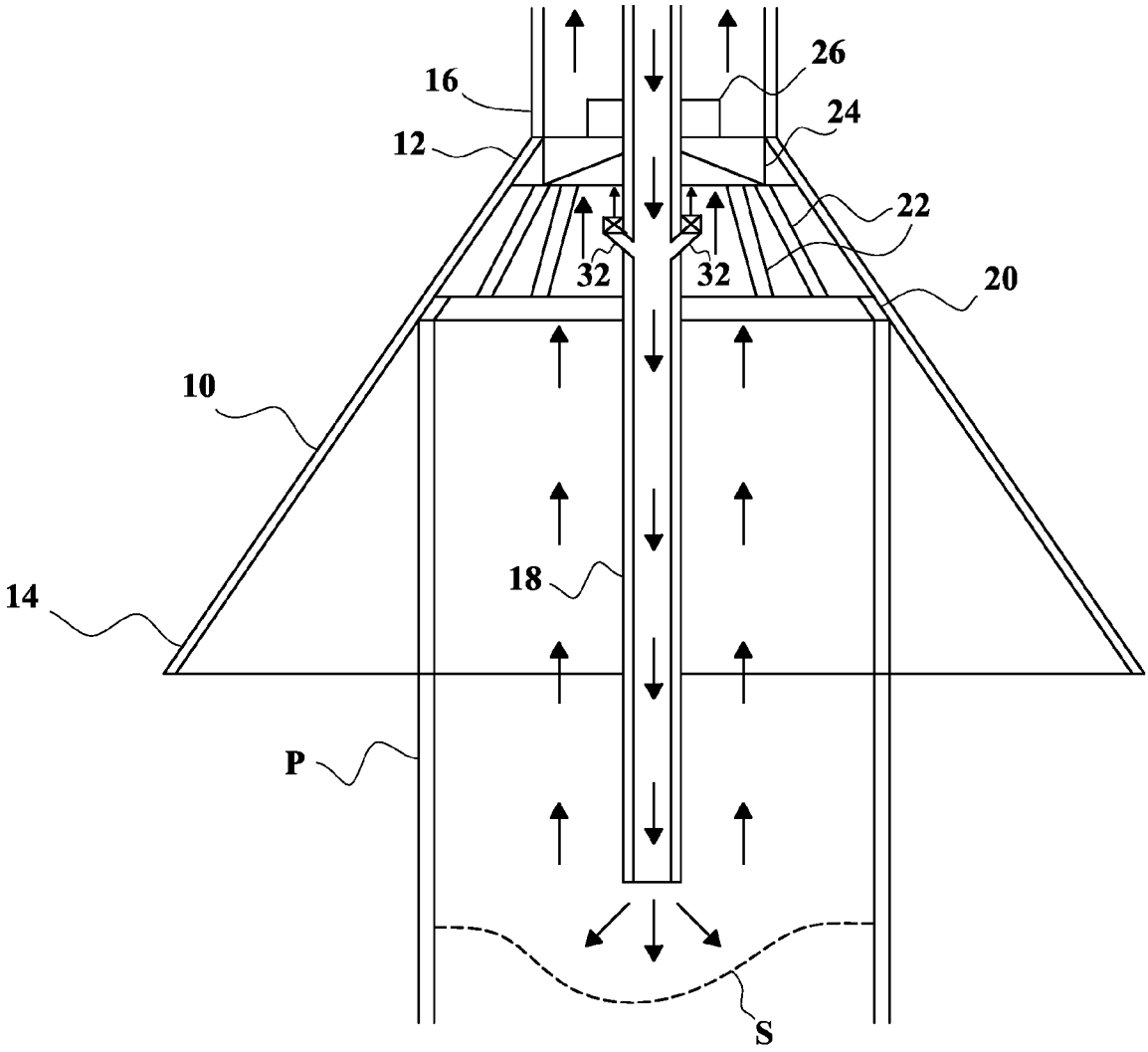
FIG. 8 is a vertical sectional view of the fourth preferred embodiment of the invention.
Figure 9:
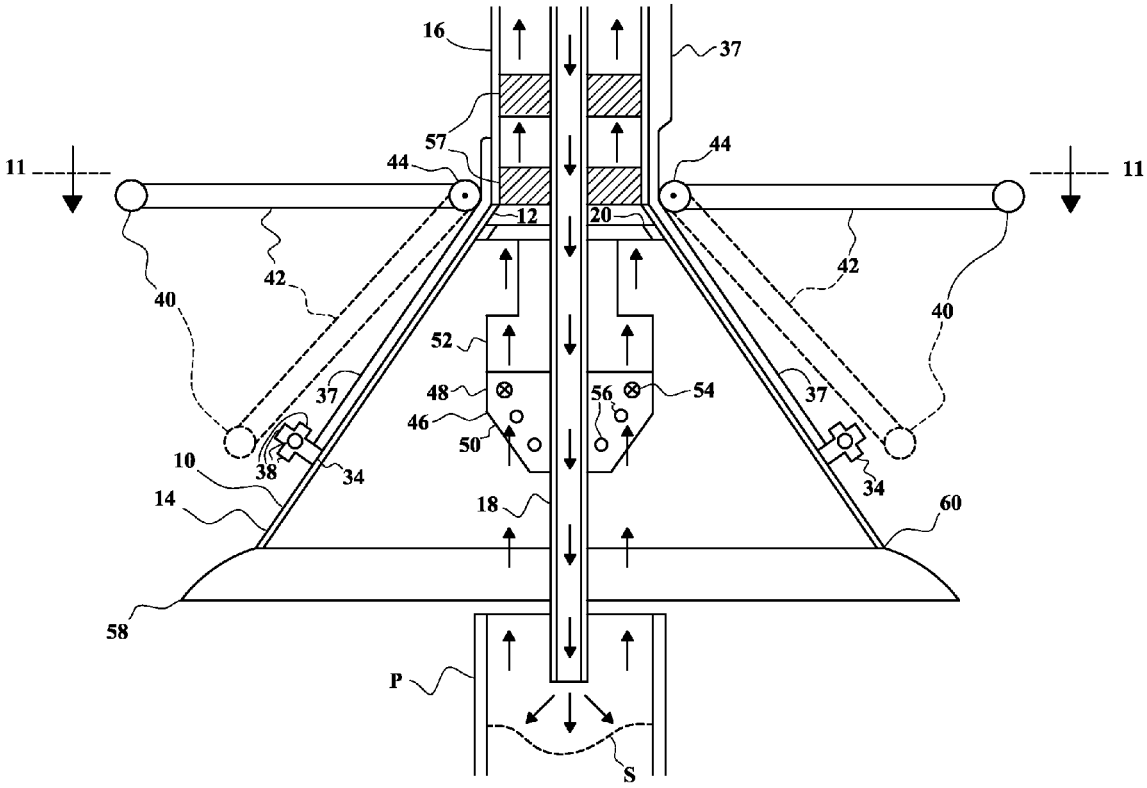
FIG. 9 is a vertical sectional view drawn along lines 9-9 of FIG. 3, showing the fifth preferred embodiment of the invention before the funnel is sucked down onto the pipe from which the first fluid is escaping.
Figure 10:
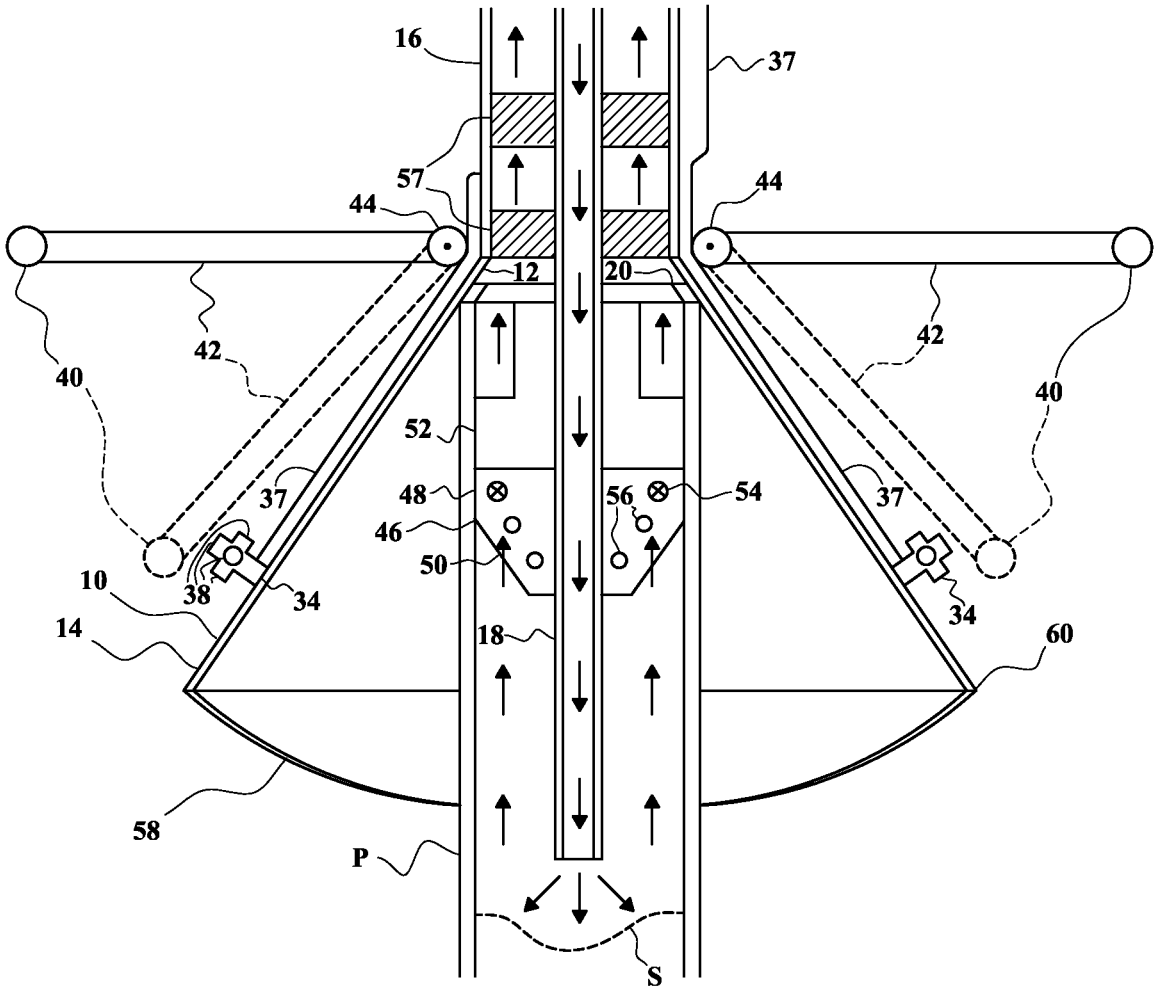
FIG. 10 is a vertical sectional view drawn along lines 9-9 of FIG. 3, showing the fifth preferred embodiment of the invention after the funnel is sucked down onto the pipe from which the first fluid was escaping.
Figure 11:
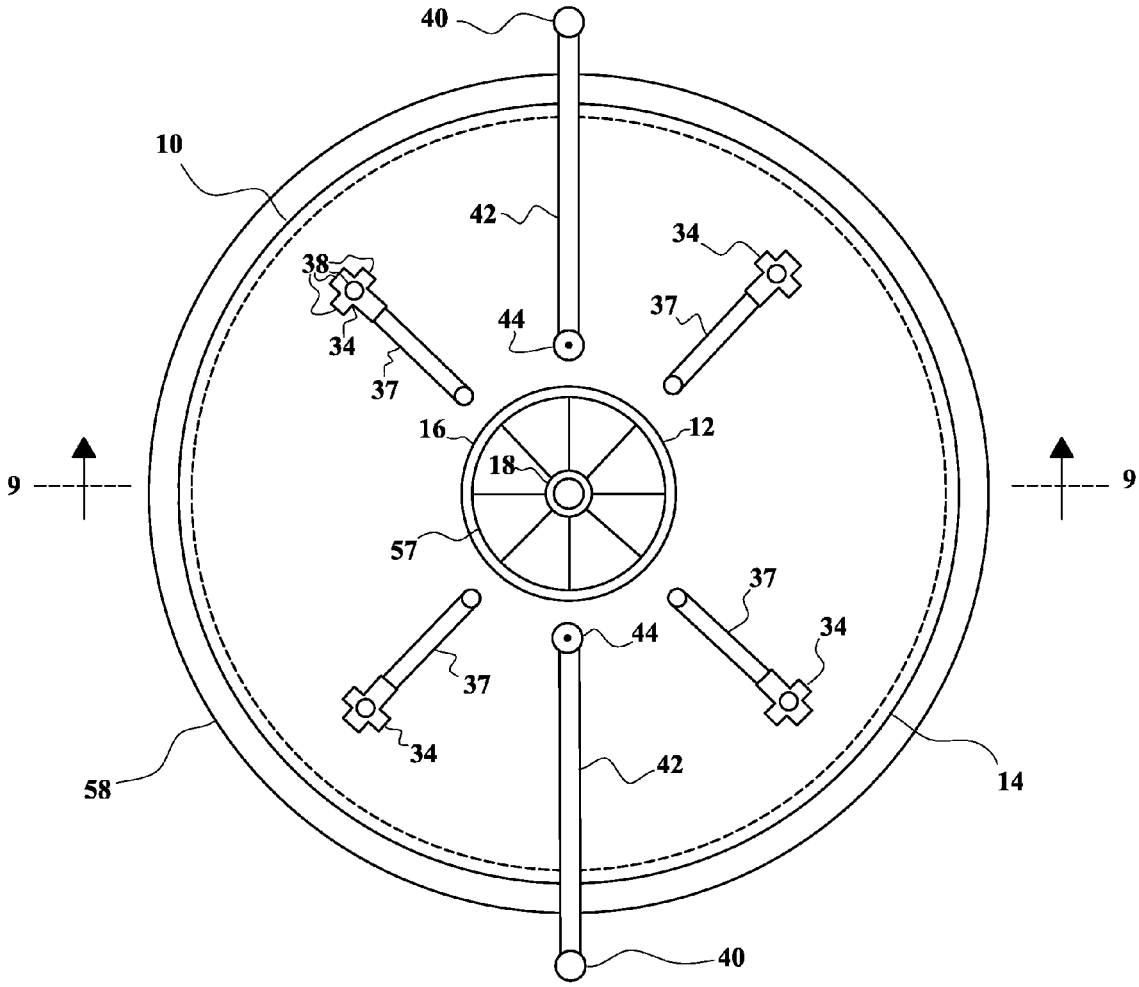
FIG. 11 is a horizontal sectional view drawn along lines 11-11 of FIG. 1, showing the fifth preferred embodiment of the invention.
Figure 12:
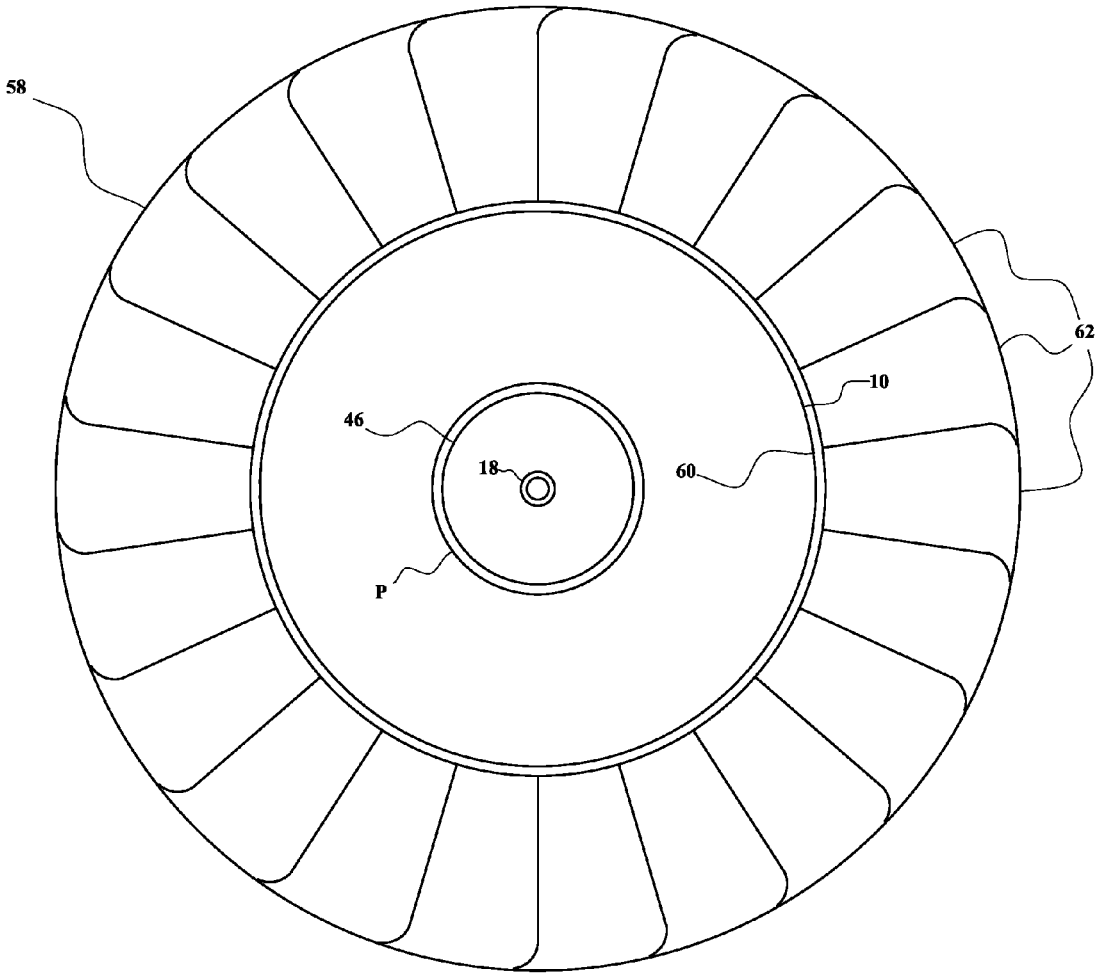
FIG. 12 is a detail view of the second gasket of the fifth preferred embodiment of the invention in an open position.
Figure 13:
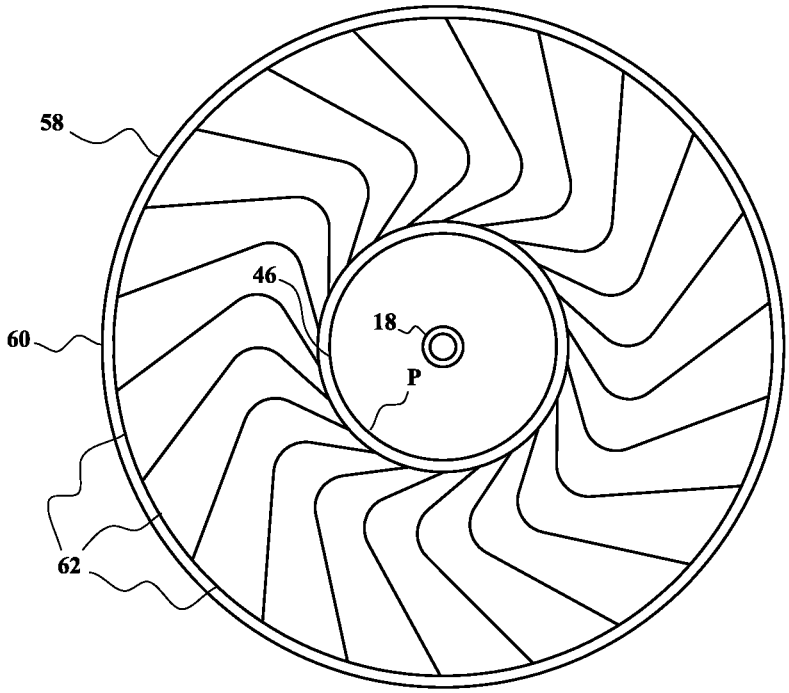
FIG. 13 is a detail view of the second gasket of the fifth preferred embodiment of the invention in a closed position.

FIG. 8 is a vertical sectional view of the fourth preferred embodiment of the invention, in which there are valves 32 in the high pressure pipe 18 just below the blades 24 that can keep the blades turning when well pressure decreases. Note that the funnel can be sucked down both by pressure from the well, and by pressure from outside sources (that supply air to the high pressure pipe or a secondary air supply or electricity or fuel to the motor 26).

The following are the new features in this Continuation-In-Part, which is a fifth preferred embodiment of the invention, shown in FIGS. 9-13:

1. Jets 34 (shown in FIGS. 9, 10 and 11) on an exterior surface of the funnel 10, through which a second fluid may be released to move the funnel into alignment with the pipe P through which the first fluid is escaping. The second fluid is supplied to the jets through a second high pressure pipe 36 with branches 37, and the jets each have a plurality of nozzles 38 that point in different directions. The second fluid will usually be air, and the air may be supplied through a compressed air pipe.

2. Sensing devices 40 selected from the group comprising lights and cameras, sonar, and global positioning system devices, on movable arms 42 (shown in FIGS. 9, 10 and 11) that can be extended from the funnel, by which the position of the funnel relative to the pipe through which the first fluid is escaping can be determined, so that it can be moved into alignment with said pipe using the jets. The arms may be moved between an extended position (shown in solid lines) and retracted position (shown in broken lines). The arms will generally be in an extended position when the sensing devices are used. There may be two arms, each moved by a motor 44, than can each rotate 180 degrees, giving 360 degree coverage of the surrounding area.

3. A stopper or plug 46 (shown in FIGS. 9 and 10) surrounding a portion of the high pressure pipe 18 inside the funnel, the stopper having an upper portion 48 with a diameter that is the same as the interior diameter of the pipe through which the first fluid is escaping, and a sloping lower portion 50, and a piston 52 that can push the stopper down into the pipe though which the first fluid is escaping. The high pressure pipe must, of course, have a smaller diameter that the pipe through with the first fluid is escaping. The piston may be moved by an explosive charge, hydraulics, compressed air, electricity, springs, or any other suitable means. The stopper increases the Bernoulli effect by its shape and position in the funnel. One-way locks 54 may prevent the stopper from being destroyed by the flow of the first fluid and pressure.

4. One-way valves 56, (shown in FIGS. 9 and 10) through which the second fluid can be released through a portion of the high pressure pipe inside the funnel, to increase the Bernoulli effect, while preventing the first fluid from escaping. The one-way valves pass through the walls of the high pressure pipe and the stopper. The one-way valves allow the second fluid (e.g., air) to enter the pipe through which the first fluid (e.g., oil) is flowing, and stop the flow of the first fluid once the stopper is activated.

5. A plurality of turbines 57 (shown in FIGS. 9 and 10) in the return pipe 16 to accelerate the flow of the first fluid. The entire system, including the turbines, may be powered by air, electrical-wire, an electrical power pack, springs, or other suitable means. The turbines are stacked in the return pipe to increase suction.

6. A second gasket 58 (shown in FIGS. 9-11, and in detail in FIGS. 12 and 13) at the larger end of the funnel, the gasket having a circular rim 60 from which extend overlapping plates 62 pivotally attached to the rim, wherein the plates can be simultaneously rotated from an open position (shown in FIGS. 9 and 12), in which they do not block the funnel from being placed over the pipe from which the first fluid is escaping, to a closed position (shown in FIGS. 10 and 13), in which they contact said pipe and prevent the first fluid from escaping to the surrounding space. The gasket may be opened and closed by a draw string 64, a spring control spool powered by a battery pack, or any other suitable mechanism. The plates may be pivotally connected to the circular rim by springs or other suitable means.

It is to be understood that the present invention is not limited to the embodiments described above, but encompasses any and all embodiments within the scope of the following claims.

I claim:

1. A blowout preventer, comprising:

a funnel having a smaller end and a larger end, with the larger end being dimensioned and configured to be placed over an open end of a pipe through which a first fluid is escaping;

a return pipe connected to the smaller end of the funnel;

a high pressure pipe passing through the return pipe and the funnel, suitably dimensioned and configured to be insertable into the pipe through which the first fluid is escaping; and jets on an exterior surface of the funnel, through which a second fluid may be released to move the funnel into alignment with the pipe through which the first fluid is escaping;

wherein, when the second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus sucking the funnel down onto the pipe from which the first fluid is escaping.

2. The blowout preventer according to claim 1, wherein the second fluid is supplied to the jets through a second high pressure pipe, and the jets each have a plurality of nozzles that point in different directions.

3. The blowout preventer according to claim 1, further comprising:

devices selected from the group comprising lights and cameras, sonar, and global positioning system devices, on movable arms that can be extended from the funnel, by which the position of the funnel relative to the pipe through which the first fluid is escaping can be determined, so that it can be moved into alignment with said pipe using the jets.

4. The blowout preventer according to claim 1, further comprising:

a stopper surrounding a portion of the high pressure pipe inside the funnel, the stopper having an upper portion with a diameter that is the same as the interior diameter of the pipe through which the first fluid is escaping, and a sloping lower portion; and a piston that can push the stopper down into the pipe though which the first fluid is escaping.

5. The blowout preventer according to claim 1, further comprising:

one-way valves, through which the second fluid can be released through a portion of the high pressure pipe inside the funnel, to increase the Bernoulli effect, while preventing the first fluid from escaping.

6. The blowout preventer according to claim 1, further comprising:

a plurality of turbines in the return pipe to accelerate the flow of the first fluid.

7. The blowout preventer according to claim 1, further comprising:

a gasket at the larger end of the funnel, the gasket having a circular rim from which extend overlapping plates pivotally attached to the rim, wherein the plates can be simultaneously rotated from an open position, in which they do not block the funnel from being placed over the pipe from which the first fluid is escaping, to a closed position, in which they contact said pipe and prevent the first fluid from escaping to the surrounding space.

8. A blowout preventer, comprising:

a funnel having a smaller end and a larger end, with the larger end being dimensioned and configured to be placed over an open end of a pipe through which a first fluid is escaping;

a return pipe connected to the smaller end of the funnel;

a high pressure pipe passing outside the return pipe and through a side of the funnel, suitably dimensioned and configured to be insertable into the pipe through which the first fluid is escaping; and jets on an exterior surface of the funnel, through which a second fluid may be released to move the funnel into alignment with the pipe through which the first fluid is escaping;

wherein, when the second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus sucking the funnel down onto the pipe from which the first fluid is escaping.

9. The blowout preventer according to claim 8, wherein the second fluid is supplied to the jets through a second high pressure pipe, and the jets each have a plurality of nozzles that point in different directions.

10. The blowout preventer according to claim 8, further comprising:

devices selected from the group comprising lights and cameras, sonar, and global positioning system devices, on movable arms that can be extended from the funnel, by which the position of the funnel relative to the pipe through which the first fluid is escaping can be determined, so that it can be moved into alignment with said pipe using the jets.

11. The blowout preventer according to claim 8, further comprising:

one-way valves, through which the second fluid can be released through a portion of the high pressure pipe inside the funnel, to increase the Bernoulli effect, while preventing the first fluid from escaping.

12. The blowout preventer according to claim 8, further comprising:

a plurality of turbines in the return pipe to accelerate the flow of the first fluid.

13. The blowout preventer according to claim 8, further comprising:

a gasket at the larger end of the funnel, the gasket having a circular rim from which extend overlapping plates pivotally attached to the rim, wherein the plates can be simultaneously rotated from an open position, in which they do not block the funnel from being placed over the pipe from which the first fluid is escaping, to a closed position, in which they contact said pipe and prevent the first fluid from escaping to the surrounding space.

14. A method of preventing blowouts, comprising the steps of:

placing a larger end of a funnel adjacent to an open end of a pipe through which a first fluid is escaping, the funnel having a smaller end that is connected to a return pipe;

moving the funnel into alignment with the pipe through which the first fluid is escaping using jets on an exterior surface of the funnel, by releasing a second fluid from the jets;

inserting a high pressure pipe into the pipe through which the first fluid is escaping;

pumping the second fluid, at a higher pressure than that of the first fluid, through the high pressure pipe into the pipe through which the first fluid is escaping;

separating the first fluid by the second fluid in a space adjacent to an end of the high pressure pipe that has been inserted into the pipe through which the first fluid is escaping; and accelerating a portion of the first fluid that is not held back by the greater pressure of the second fluid, causing it to flow through the funnel and the return pipe at an increased velocity, but at a reduced pressure due to the Bernoulli effect, thus sucking the funnel down onto the pipe from which the first fluid is escaping.

15. The method of preventing blowouts according to claim 14, wherein the second fluid is supplied to the jets through a second high pressure pipe, and the jets each have a plurality of nozzles that point in different directions.

16. The method of preventing blowouts according to claim 14 comprising the further steps of:

extending movable arms from the funnel; and determining the position of the funnel relative to the pipe through which the first fluid is escaping using devices selected from the group comprising lights and cameras, sonar, and global positioning system devices, on the movable arms, so that the funnel can be moved into alignment with said pipe using the jets.

17. The method of preventing blowouts according to claim 14 comprising the further steps of:

pushing a stopper down into the pipe though which the first fluid is escaping, using a piston, said stopper surrounding a portion of the high pressure pipe inside the funnel, having an upper portion with a diameter that is the same as the interior diameter of said pipe, and a sloping lower portion;

increasing the Bernoulli effect by releasing the second fluid through one-way valves in a portion of the high pressure pipe inside the funnel, while preventing the first fluid from escaping; and engaging one-way locks to prevent the stopper from being dislodged.

18. The method of preventing blowouts according to claim 14 comprising the further step of:

accelerating the flow of the first fluid using a plurality of turbines in the return pipe.

19. The method of preventing blowouts according to claim 14 comprising the further step of:

simultaneously rotating overlapping plates extending from a circular rim of a gasket at the larger end of the funnel, from an open position in which the plates do not block the funnel from being placed over the pipe from which the first fluid is escaping, to a closed position, in which they contact said pipe and prevent the first fluid from escaping to the surrounding space.

* * * * *